US005476575A

United States Patent [19]

Brophy et al.

[11] Patent Number: 5,476,575

[45] Date of Patent: Dec. 19, 1995

[54] FABRICATION OF MOLY MASKS BY ELECTROETCHING

[75] Inventors: Denis J. Brophy, Staatsburg; Madhav Datta, Yorktown Heights; Derek B. Harris, Dryden; Matthew T. Kurdziel, Salt Point, all of N.Y.; Frank S. Ryan, Boulder, Colo.

[73] Assignee: International Business Machines Corporation, Armonk, N.Y.

[21] Appl. No.: 285,371

[22] Filed: Aug. 3, 1994

[51] Int. Cl.[6] ..... C25F 3/02; C25F 7/00

[52] U.S. Cl. ..... 204/129.5; 204/129.55; 204/129.65; 204/129.7; 204/129.75; 204/129.95; 204/224 M

[58] Field of Search ..... 204/129.65, 224 M, 204/129.7, 129.75, 129.55

[56] References Cited

U.S. PATENT DOCUMENTS

| | | | |
|---|---|---|---|
| 4,045,312 | 8/1977 | Satoshi | 204/129.65 |
| 4,082,632 | 4/1978 | Whittle | 204/129.65 |
| 4,110,190 | 8/1978 | Visser | 204/224 M |
| 4,119,514 | 10/1978 | Whittle | 204/129.65 |
| 4,208,257 | 6/1980 | Hom-ma et al. | 204/129.65 |
| 4,212,907 | 7/1980 | Wright | 427/309 |
| 4,628,588 | 12/1986 | McDavid | 29/571 |

OTHER PUBLICATIONS

B. Braren et al., "One Step Mask Making", *Research Disclosure,* Kenneth Mason Publications Ltd. (Sep. 1990).

W. B. Pennenbaker, "Electropolishing of Metal–Film Structures", *IBM Technical Disclosure Bulletin,* vol. 14, No. 10, pp. 3023–3025, Mar. 1972.

*Primary Examiner*—Donald R. Valentine

*Attorney, Agent, or Firm*—Ratner & Prestia

[57] ABSTRACT

Masks for microelectronics technology are fabricated by electrochemical etching. Molybdenum sheet or foil is masked with patterned photoresist on one side, and a mating, mirror-image pattern of photoresist is applied on the other side of the foil in exact registration with the first pattern. The foil is immersed in electrolyte (an aqueous solution of sodium nitrate, sodium hydroxide, thiourea, and surfactant) along with nickel anode plates held parallel to the foil surfaces 1–3 cm away. The anode plate is made slightly smaller than the mask area of the foil. When voltage is applied across the cell, the foil is etched through to form vias. The electrolyte is pumped across the surface of the foil and uniform flow velocity over the foil surface is achieved.

24 Claims, 4 Drawing Sheets

FABRICATION OF MOLY MASKS BY ELECTROETCHING

BACKGROUND OF THE INVENTION

1. Field of the Invention

The present invention relates to fabricating metal masks, especially molybdenum masks for microelectronic packaging.

2. Description of the Prior Art

Microelectronics uses crystals, usually of the semiconductor silicon. The crystals are sawed into "wafers," end processed by layering and diffusing various materials onto the crystal surface to form components such as transistors and resistors, which make up the circuits of the device.

The surface of a crystal wafer measures a few inches (up to 8") across, while the devices are only a fraction of an inch across. Each crystal wafer contains dozens to hundreds of copies of one device, laid out in a repeating pattern. After the devices are formed, the wafer is broken into rectangular pieces called "chips" or "dice" (singular "die"), with each die containing one device.

To be useful, a die must be electrically connected to other electronic devices. This connection cannot easily be made by directly wiring the dice together. Instead, the dice are "packaged" in units. A package includes conductive leads that extend from the outside of the package to metal pads on the die.

Inside the package, the die is glued onto a substrate, which might be made of various materials. The substrate material is desirably mechanically strong and rigid to support the dice, desirably an insulator so that the electronic currents flowing through the package will not leak away, and desirably expands with rising temperatures in about the same way as silicon does. If the dice expanded and shrank relative to the substrate, they might break off after too many heating and cooling cycles. Substrate materials include ceramics such as alumina, plastics such as polyimide, and silicon crystals which are highly purified (and so not very conductive, unlike doped silicon).

After mechanical mounting, electrical connections are made from the die to the prongs, pins, or pads on the outside of the package.

A microelectronic circuit's speed and cost are directly related to its size, so the components on a chip are made as finely as possible. Chip component sizes have decreased at about ten percent per year due to engineers' continuing efforts to make the components as small as possible. Since the chips must also communicate, package sizes may also be small. Packages take up a large share of the processing time delays and the cost of electronic devices. Small, but dense, packages are commercially important.

A method in the prior art of connecting a die to the outside leads was by soldering very fine gold wires between the leads and the die pads. A more recent and efficient method, Tape Automated Bonding (TAB), uses a sandwich of insulating plastic and patterned conductive molybdenum foil laid out in strips that act as wires. Each die pad has a tiny solder bump. The foil pattern is aligned to the die pads so that the end of each strip of molybdenum is above a pad solder bump. The foil is pressed onto the chip, and the solder bumps connect the foil strips to the pads, making all the connections at once. TAB allows pads to be spaced only 0.25 mm apart around the perimeter of the chip package.

Molybdenum has been used because its coefficient of thermal expansion is about the same as silicon's coefficient of thermal expansion. When the temperature varies, both molybdenum and silicon expand or shrink by the same amount. This prevents misalignment of the pads and foil strips. Molybdenum also has good mechanical properties and conducts heat well.

Molybdenum's mechanical strength, convenient thermal expansion coefficient, conductivity, and ability to withstand high temperatures make it useful for other applications in microelectronics technology. One such application is "moly masks," sheets of molybdenum foil used as templates for various microelectronic fabricating operations.

Moly masks are used with Controlled Collapse Chip Connection (C4) packages. C4 is also known as "solder bump" and "flip chip." In C4, the entire surface of the chip package is covered with conductive pads. The package is pressed down onto a substrate or PC board with corresponding pads having solder bumps or balls, partially collapsing the solder balls and making connection between the respective pads. C4 allows a high density of electrical interconnections. It differs from the TAB system in that the pads cover an entire side of the chip, rather than the perimeter.

The type of moly mask used for C4 is a "device mask" or "evaporation mask," a sheet with up to 100,000 holes through it. Each hole, or "via," is about 4 thousandths of an inch in diameter. The vias in the mask are used to form the tiny solder bumps in place.

In a high-vacuum chamber, the mask is placed over a silicon wafer in precise alignment with the components on the wafer surface. Solder is evaporated above the mask, and the metal vapor comes through the vias and condenses on the wafer surface to make the solder bumps. The vias on the moly mask are desirably located to a precision of plus or minus 4 ten-thousandths of a inch, or the terminal metal may condense in the wrong places and ruin a very expensive wafer. When heated, the molybdenum expands along with silicon, thus keeping the pads and vias in registration.

Another type of moly mask, used for making multi-layer ceramic (MLC) substrates, is a "screening mask." The vias in a screening mask serve as a mold through which screening paste, made of molybdenum powder and binder, is squeezed onto selected areas of a substrate. The mask is laid onto the substrate and paste is extruded into the mask holes from a nozzle passed over the mask. Excess paste is removed from the mask surface. The substrate is then fired in an oven to drive off the binder and to sitter the powder into conductive metal. The areas between conductive metal regions are filled with a non-conductive glass or ceramic material.

This process can be repeated on a substrate, using a series of different masks, to form a stack of layers. The masks are designed so that the conductive metal patterns interconnect between layers an selected points. The whole stack thus forms a complex circuit for electrically joining various chips mounted on the substrate surface.

The MLC process cam be applied to substrates as large as 127 mm (5 inch) square, containing thousands of vias and lines in degrees of layers and containing up to millions of connections.

The vias in a screening mask may be only on the order of a thousandth of an inch in diameter, so the dimensional stability of screening masks is a critical criterion.

A prior art method of making moly masks includes the use of photolithography and chemical etching on molybdenum foil. This technique is well known to one skilled in the art.

One solution commonly used to dissolve the molybdenum foil is alkaline potassium ferricyanide. It is often sprayed onto the mask surface, as is discussed in *The Principles and Practice of Photochemical Machining and Photoetching*, by D. M. Allen, published by Adam Hilger, Boston (1986).

Potassium ferricyanide and other cyanide solutions which are used for etching are highly toxic. Furthermore, cyanide in the form of fumes or discarded chemicals is an environmental pollutant. In the work place, cyanide fumes are especially insidious because cyanide dulls the sense of smell. Workers can be exposed to increasingly concentrated poisonous fumes while believing that the fumes are vanishing. Cyanide has recently been banned in New York State.

Besides the danger and pollution of cyanide etching, the process has other drawbacks. It is a slow process, which means that a large capital investment and much cyanide are needed to produce masks at a certain rate. Another problem is the limitations on the "aspect ratio" of the openings in the moly mask foil, the ratio of opening width or via diameter to foil thickness.

The cyanide etch does not bore straight into foil like a drill. The etching is isotropic and acts on all exposed surfaces, and the cyanide eats away the molybdenum under the edge of the photoresist. This undercutting limits the aspect ratio.

Undercutting increases the size of mask holes and slots beyond what was intended. It also blurs the sharp outlines defined by the photoresist edges and limits the closeness of vias or other features.

Since the mask is left in the cyanide long enough to dissolve the foil thickness, the cyanide will have a roughly equal time to dissolve under the edge of a photoresist ledge. Thus, to a first approximation, the undercut width will be of the same order as the thickness of the foil. However, the foil cannot be made too thin or it will lack mechanical strength.

The undercutting resulting from the cyanide process limits the fineness of the mask pattern and prevents moly masks from being used with small microelectronic components. Any decrease in undercutting would be a commercial advance.

Several drawbacks of chemical etching can be overcome by substituting electrochemical etching, in which an electrolyte (salt solution) and electricity are combined to etch metal. The etched metal is called an anode. Another piece of metal, called the cathode, is immersed in the salt solution along with the anode, and a voltage is maintained between them. The combination of electric current and electrolyte gradually etches the anode, which dissolves away. The salt solutions used are harmless and the voltages are low, so the process is safe and non-polluting.

One form of electrochemical etching is electrochemical machining (ECM). ECM employs a having a certain desired shape, a fluid electrolyte, and intense electric currents between the tool and a metal workpiece. ECM forms a depression shaped like the tool in the workpiece. During the machining operation electrolytic fluid is continuously pumped at high rates through the small gap between the tool and workpiece.

FIG. 1 illustrates a basic electrochemical etching cell. A tank T holds liquid electrolyte E, an aqueous solution of a salt (for example, table salt and water). The anode A and the cathode C are wired to a voltage source such as a battery B. When the apparatus is electrified, metal atoms in the anode A are ionized by the electricity and forced out of the metal into the solution, so that the metal dissolves in the water. The rate of dissolution is proportional to the electric current, according to Faraday's Law. Depending on the chemistry of the metals and salt, the metal ions from the cathode either plate the cathode, fall out as precipitate, or stay in solution.

Electrochemical machining (ECM) is based on the basic electroetching set-up of FIG. 1. In conventional ECM, the cathode is a shaped tool which is held close to the anode and slowly moves toward it. The anode is the workpiece, which is machined away as it dissolves. A variation of ECM is resist pattern ECM or electrochemical micromachining (EMM), in which a resistant layer is adhered to the surface of the anode. Etching takes place in between the resist layers on the bare metal, without any need to move the cathode or maintain a close tolerance on the anode-cathode distance.

U.S. Pat. No. 4,212,907, issued to Ralph Wright, teaches a method of treating the surface of molybdenum prior to depositing a nickel-phosphorus coating. The surface is anodized in an acidic medium to form a film of gray molybdenum oxide, and then the film is removed. The treatment improves the adhesion between the molybdenum and the nickel, and is useful in making laser components.

James McDavid teaches the use of molybdenum masks in the fabrication of metal-gate semiconductor devices in U.S. Pat. No. 4,628,588. His invention addresses the problem of removing molybdenum oxides from a sidewall of an oxide/molybdenum stack. His method first builds layers of refractory material, insulator, molybdenum, and patterned photoresist, then etches through the molybdenum using the photoresist as a mask, and finally etches the insulator using the etched molybdenum as a mask.

SUMMARY OF THE INVENTION

A laminar metal foil having am ask area is etched. A masking pattern including bare regions and coated regions is placed onto the mask area. A cathode having a cathode area is provided. The cathode is disposed at a fixed inter-electrode distance from the mask area. A space between the mask area and the cathode is then filled with a liquid electrolyte. After the electrolyte is induced to flow over the mask area, a relatively positive foil voltage and a relatively negative cathode voltage are provided such that the foil is electroetched in the bare regions. The relatively positive foil voltage and the relatively negative cathode voltage are then maintained until the foil is etched through to create openings.

DETAILED DESCRIPTION OF THE PRESENT INVENTION

The following terms are used throughout the specification with the following definitions:

molybdenum—molybdenum or an alloy of molybdenum;

inner-electrode distance—a distance measured from a point on the cathode to the anode surface, along a direction perpendicular to the cathode surface at that point;

mask area—any area of a foil which may be etched (the mask area may be on one or both sides of the foil, and may be continuous or consist of separated sub-areas);

masking pattern—refers to a set of continuous regions which are alternately coated (masked or covered, as by photoresist) and bare (un-masked or un-coated);

relatively positive and relatively negative—jointly refer to electrical polarity as regards to one another, and without regard to ground potential;

immersed—the immersed object is wholly or partially wetted by liquid such as electrolyte;

hydraulic resistance element—a baffle plate (with holes, slots, etc.), a manifold, a filter, a screen, vanes, propellers, or any other structure which resists the flow of a liquid electrolyte; and laminar—having at least one smooth surface which can be singly curved or flat.

The present invention relates to an apparatus and method for forming vias or other openings in a metal foil or thin sheet. An exemplary application of the invention is making masks for microelectronics fabrication. Since molybdenum metal has properties uniquely suited to microelectronics, the invention applies especially to making molybdenum masks, hereinafter called moly masks.

Figure 1:
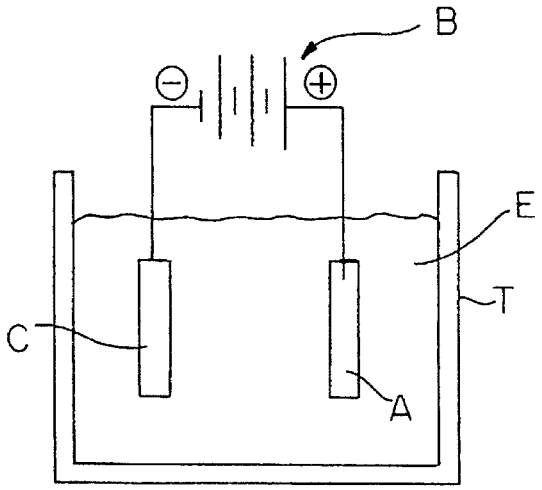
FIG. 1 is a schematic view of an electrochemical etching cell in accordance with the prior art.
Figure 2:
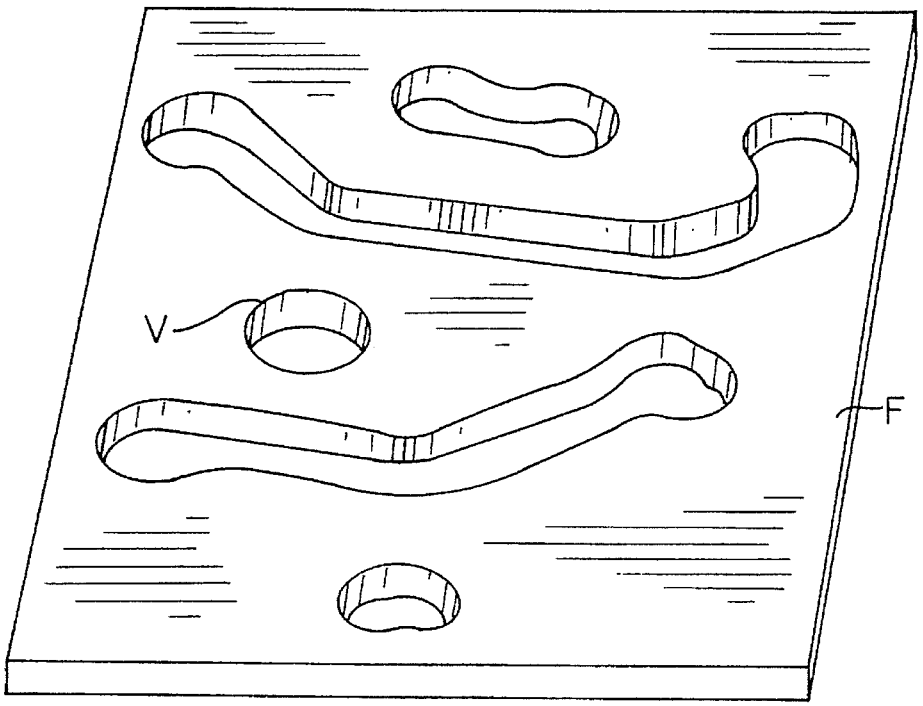
FIG. 2 is a perspective view of a portion of a moly mask with vias and openings.

FIG. 2 is based upon a scanning electron micrograph of a moly mask made according to the present invention. It shows a section of the mask area of a foil F with openings and vias V formed by etching according to the present invention. The view is magnified; the width of the openings ranges from 0.0028 to 0.0048 inches. The foil F is 0.0030 inches thick.

In the present invention, resist pattern electroetching is used to make holes in metal foil. Patterned photoresist (or another masking material) is placed onto the foil surface by conventional means, such as photolithography. Referring again to FIG. 2, the areas of metal in between the holes and slots were covered with protective resist during etching, which caused the bare metal to be eroded in the regions without resist. As etching continued in the bare regions, the foil was eventually pierced to form the holes seen in FIG. 2. Following etching, the resist mask was removed. FIG. 2 shows the foil F after the resist was removed.

The masking material is desirably an electrical insulator, and is desirably not be soluble in water.

To increase the speed of etching and piercing, the foil is preferably etched on both sides at once. Two separate masks 220*a* and *b* (see FIG. 3) are used, which are perfect mirror images of one another. The photoresist masks on either side of the foil must be exactly registered on the two sides.

Figure 3:
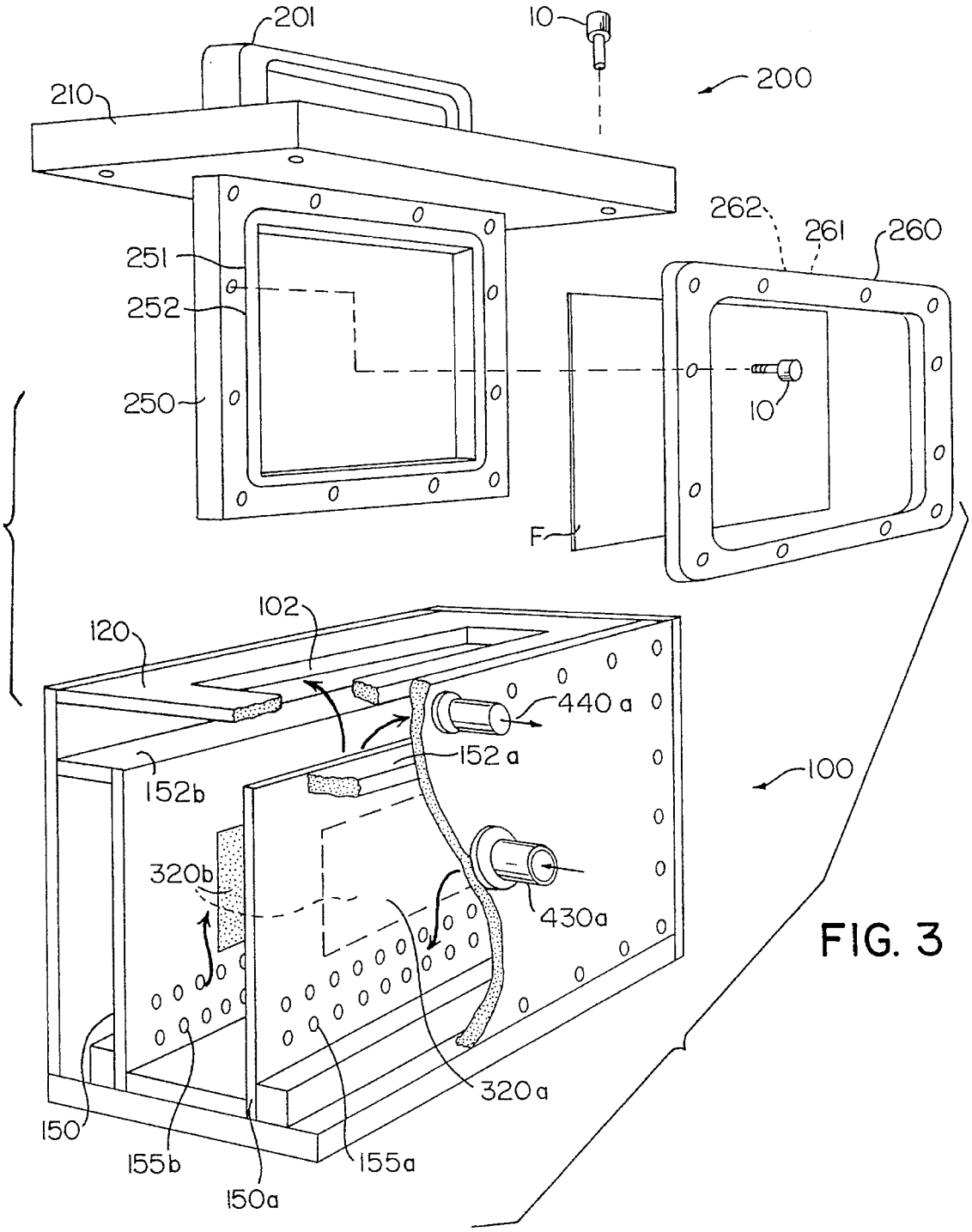
FIG. 3 is a perspective, partially exploded view of an etching apparatus in accordance with an exemplary embodiment of the present invention.

FIG. 3 depicts an apparatus which represents an exemplary embodiment of the present invention. The apparatus is shown in exploded view, with a cover assembly 200 above the box-like container 100 (corresponding to the tank T of FIG. 2). Likewise, the clamp plate 260 is shown exploded away from the frame 250, exposing the foil F that is clamped between them when the invention is in use. The foil F is 9 inches square in the depicted apparatus.

The container 100 is water-tight except for a slot 102 in its top plate 120 (which accepts the cover frame 250) and piping connection orifices 430, 440. The container 100 is full of circulating electrolyte when in use. (The electrolyte is not shown in FIG. 3.) Container 100 may be constructed of any suitable material, preferably an insulating material such as clear plastic. An end plane of the container 100 is non shown in FIG. 3, and portions of the side walls and top plane 120 are cut away no make the internal structure apparent.

The cover assembly 200 includes a cover plane 210, handle 201 for lifting the cover assembly 200 out of the container 100, and frame 250 for mounting the foil F for etching. The frame 250 includes a groove 251, in which an O-ring type gasket 252 lies. The foil F is placed onto the frame 250 so than the foil F overlies the gasket 252. Then the clamp plane 260 is placed over the foil F and fastened onto the frame 250 with screws 10. This completes the cover assembly 100.

The side of the clamp plane 260 which faces the foil F has a groove 261 and O-ring 262 just like the groove 251 and O-ring 252 of the frame 250. These gaskets prevent leakage between the two sides of the foil F.

The cover assembly 200 is lowered into the slot 102 and fastened down to the container 100 with screws 12. A gasket (non shown) may be provided between the underside of the cover plate 210 and the top plate 120 to prevent leakage of electrolyte.

Figure 4:
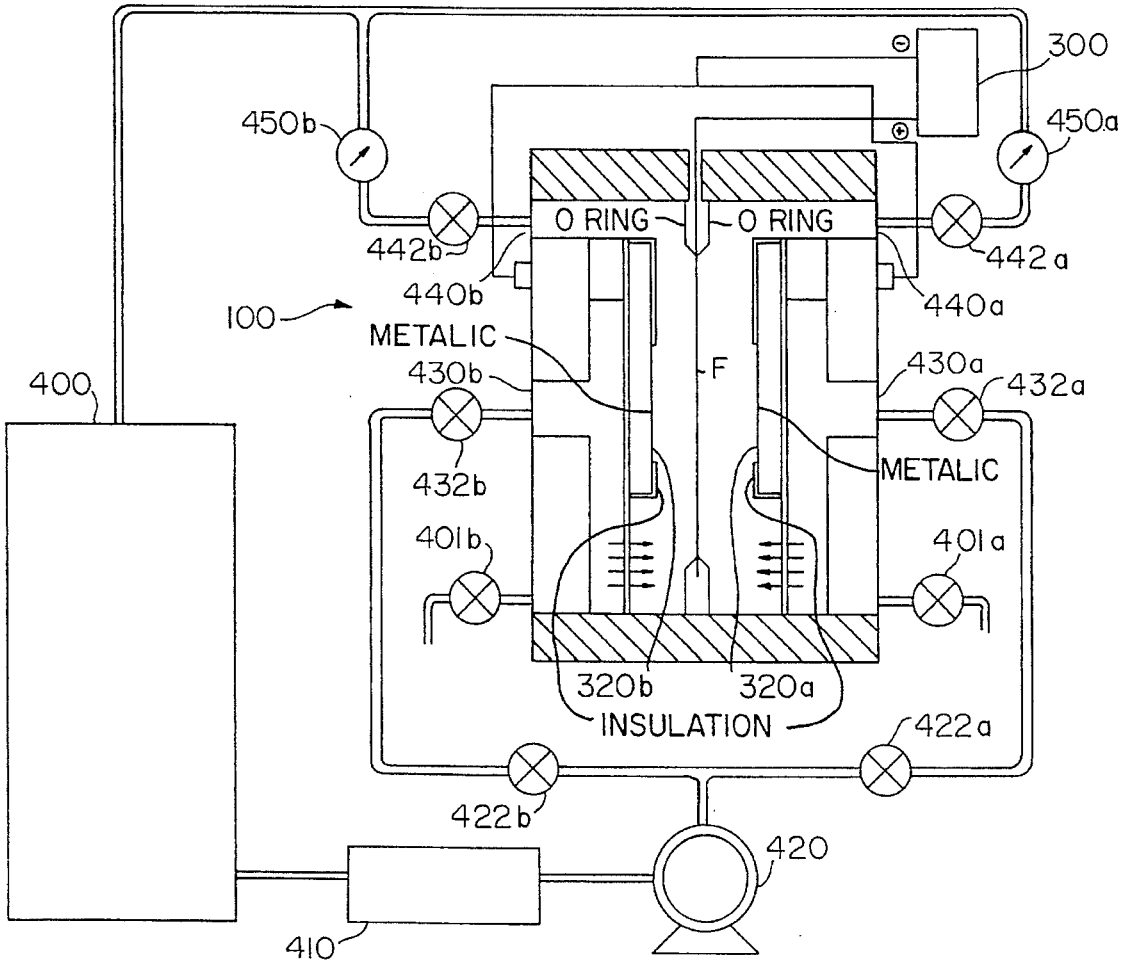
FIG. 4 is a schematic view of the present invention.

Upon assembly of the apparatus, the frame 250 and foil F divide the interior space of the container 100 into two halves. The apparatus illustrated by FIG. 3 is made so that electrolyte does not leak excessively from one side of the frame 250 to the other when the apparatus is assembled. If the clearances are too great, gaskets may be provided. The apparatus is also illustrated by FIG. 4.

During the etching process, electrolyte is pumped into the orifices 430*a* and *b*. Flow is indicated by arrows in FIG. 3. The electrolyte enters, on either side of the container 100, a chamber formed by the walls of the container 100, baffle plates 150*a* and *b*, and upper plates 152*a* and *b*. The electrolyte flows out of these chambers through holes 155*a* and *b* in the lower portion of the baffle plates 150*a* and *b*. The holes 155*a* and *b* distribute the flow evenly along the length of each baffle plate 150*a* and *b*. The electrolyte flows upward between the baffle plates 150*a* and *b* and the foil F. The interior of the frame 250 and clamp plate 260 may be beveled to decrease electrolyte flow resistance.

At the top of baffle plates 150*a* and *b*, the electrolyte flows out through the orifices 440*a* and *b*, respectively. To improve the flow characteristics, a plurality of orifices, or a manifold, may be provided on either side of the container 100. The flow should be uniform, as is discussed more fully below.

Metal cathodes 320*a* and *b*, preferably of nickel, are attached to each of the inward-facing sides of the baffle plates 150*a* and *b*, respectively. The attachment is by any conventional means. Electrical connections from the voltage source to the foil F and metal cathode 320*a* and *b* are not shown in FIG. 3; see FIG. 4. These connections may be made by any conventional means.

FIG. 4 shows the container 100 and cover assembly 200, assembled together, in schematic view. Double lines indicate pipes or tubes to carry electrolyte, and single lines indicate electrical wires.

The electrical circuit is from the positive terminal of the power supply 300 to the foil F, through the electrolyte into the metal cathodes 320*a* and *b*, and back to the negative terminal of the power supply 300. The power supply and wiring are conventional.

The hydraulic system includes an electrolyte reservoir 400, filter 410, pump 420, valves 422*a* and *b*, valves 432*a* and *b*, influx orifices 430*a* and *b*, container 100, outflux orifices 440*a* and *b*, valves 442*a* and *b*, and flow sensors or flow meters 450*a* and *b*. The filter 410 removes precipitates from the electrolyte. Drains 401*a* and *b* may be provided on the container 100 for draining electrolyte from the container 100.

When operating the apparatus of FIG. 3, the pump 420 is switched on after assembly. The various valves are adjusted to set the electrolyte flow to between 4 and 12 gpm (gallons per minute). After the sensors 450*a* and *b* indicate a stable flow, the cell voltage across the power supply 300 is set between 4 and 10 volts and electroetching begins. The current is between 20 and 70 amperes, and is maintained for 60 to 120 seconds.

There are several considerations in designing the inter-electrode spacing, that is, the distance between the plane of the etched foil surface and the parallel plane of the nickel plate as measured along a line perpendicular to either surface.

One factor is hydrodynamics. The flow velocity of electrolyte over a surface of the foil F is a function of the pumping pressure, the hydrodynamic resistance of the container and piping, and the cross-sectional area available to the flowing electrolyte between the foil F and the respective baffle plates 150*a* and *b*. The closer the anode and cathode planes are, the smaller is the cross sectional area. The average flow must be fairly high, since it is well-known from electrochemical machining practice that a high flow rate is required for efficient etching.

Another factor is electrical. The electrolyte resists the flow of electric current; its resistivity is such that a 1-inch cube of electrolyte has a resistance on the order of one ohm. The total resistance between the anode and cathode thus depends directly on the electrode spacing, and so do the voltage needed across the electrolytic cell and the energy requirements of the process.

Bubbles form on the nickel cathode as a normal part of the electrolytic action. If the foil F and the nickel plates 320*a* and *b* are too close together, the bubbles may bridge the gap before floating away and stop etching on the mask surface where they touch.

Sparking may also affect the moly mask. If the planes are very close, and the voltage is high, sparks may flash between the anode and cathode. This is to be avoided, as the moly mask may be damaged.

The preferred inter-electrode spacing is between 1 and 3 cm.

Tests were carried out to determine the best electrolytes and operating conditions for the invention. The tests measured the current flowing through the anode (molybdenum foil), electrolyte, and cathode as a function of several independent variables. The independent variables included voltage, electrolyte flow velocity over the foil surface, and electrolyte chemical composition.

The cell current is a desirable quantity to be measured, since the metal dissolution rate is directly proportional to the electric current for a given valence (ionization charge) of the metal.

Preliminary experiments with 5M (5-molar concentration) neutral salt solutions of sodium chloride (NaCl), sodium nitrate ($NaNO_3$), and potassium sulfate ($K_2SO_4$) showed that they are all feasible electrolytes for molybdenum.

To test the effect of electrolyte flow velocity, anodic dissolution behavior was studied in a separate set of experiments using rotating disc electrodes at various rates of spin. These tests were useful since the velocity of the electrolyte over the surface is proportional to the spin rate and the distance from the center of the disc.

With the rotation rate fixed at 1000 revolutions per minute, current densities were measured as a function of anode potentials between 0 to 4 volts. Various electrolyte solutions were tested under these circumstances: 0.5M $K_2SO_4$, 5M $NaNO_3$, 5M NaCl, and 4M $NaNo_3$+1M $HNO_3$. All of these electrolytes gave similar current-voltage behavior.

It was found that the rotation speed of the disc had little effect on the dissolution rate when the electrolyte contained neutral salts or salts plus an acid (4M sodium nitrate and 1M nitric acid).

However, when the electrolyte contained a salt and a base (3M sodium nitrate and 0.1M sodium hydroxide), the limiting current was dependent on the spin rate, showing that the dissolution of molybdenum is mass transport-controlled under those circumstances. The current density at −0.2 volts anode potential varied from less than 50 milliamperes per square centimeter at 100 RPM to about 200 milliamperes per square centimeter at 6000 RPM.

As a result of these experiments, a preferred electrolyte solution was found to be a 2M–5M sodium nitrate solution, with 0.05M–1M sodium hydroxide to allow mass-transport-controlled dissolution.

It was determined, by measuring the anodic weight loss and applying Faraday's Law of Electrochemistry, that molybdenum always dissolved in its highest valence of 6+ regardless of anode potential. (See M. Datta, *IBM Journal of Research and Development*, vol. 37, no. 2, pp. 207–226, 1993 which is incorporated herein by reference). If the metal had dissolved in different valences, this would have made the etch rate more dependent on the current distribution instead of mass transport.

Figure 5:
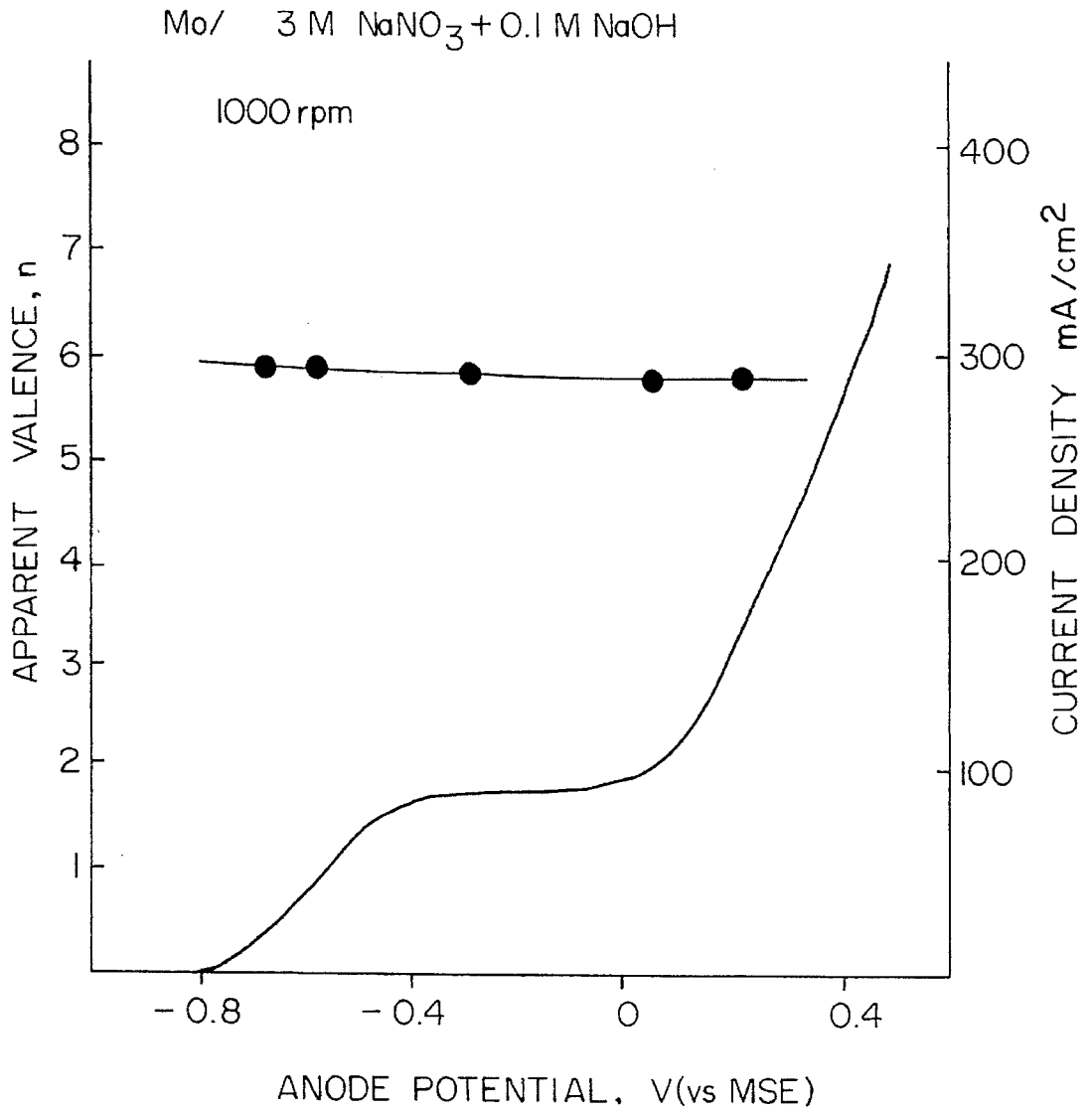
FIG. 5 is a graphical view showing the relationship between cell voltage, current density, and dissolution valence in the invention.

These data are summarized in FIG. 5. Anode voltage is plotted against both electric current density in $mA/cm^2$ and apparent molybdenum valence.

Tertiary current distribution corresponds to etching conditions that take place at or above the mass transport controlled limiting current. The cell voltage or current density was chosen so that etching was by mass transport controlled dissolution reaction, thus providing uniform current distribution conditions and yielding uniform and smooth etched surfaces (electropolishing).

The present invention allows very fast etching, removing 1 micron per second. This is 4 to 10 times faster than chemical etching. Moreover, because etching is carried out under electropolishing conditions, the surfaces on the etched mask are extremely smooth.

Besides sodium hydroxide, other chemicals may improve the electrolyte and are preferably included in the electrolyte.

Surfactants decrease surface tension and improve wetting. (Ordinary detergent is a surfactant.) The improved wetting insures that the electrolyte equally wets (contacts) all regions of the moly mask and so acts equally on all those regions. The preferred electrolyte contains a non-foaming surfactant, such as FC-98, made by the 3M company, which may be added at a concentration of 20–200 ppm (parts per million), perferably 100 ppm. ("3M" is a trademark.)

Thiourea (available, for example, from Aldrich Chemical Company), a baking agent, is preferably added to the electrolyte at a concentration of 10 mM to 30 mM, preferably 20 mM.

Banking agents adsorb onto the foil surface, but adsorb more strongly in comers, such as beneath undercut photoresist ledges. The adsorbed banking agent inhibits dissolution of the metal, so that the corners where it accumulates have a slower rate of metal removal. Thus, banking agents tend to prevent undercutting at the edges of the mask pattern.

The addition of thiourea and surfactant were not found to affect the electroetching process efficiency.

The present invention lessens undercutting by 50% to 100% and thereby allows finer mask details than are possible with chemical etching. The improvement is through uniform flow control and addition agents that give directional current distribution.

When dissolution is not mass transport controlled, then local variations in the metal surface voltage, caused by irregularities in the atomic structure, lead to irregular dissolution rates. When it is mass transport controlled, then hydrodynamic conditions determine the uniformity of etching. If the electrolyte flow velocity over the mask area is not uniform, etching will be uneven. If the etching process is slow in some regions, undercutting continues in other places where the foil is already pierced.

To maintain uniform flow of electrolyte over the foil F (and especially the mask area) surfaces during electroetching, the apparatus shown in FIG. 3 employs the baffle holes 155. The holes 155 present a hydraulic resistance, while the chamber just upstream has low resistance. This makes the pressure on the baffle plate 150 even and promotes uniform flow through the row of holes 155 and over the foil F.

Also in accordance with the invention are other means of directing liquid into uniform flow or of introducing hydraulic resistance, such as for example, slots, screens, vanes, and any other structure for these purposes.

It has been found that back pressure in the container 100 created by partial closing of the valves 442 helps in controlling the electrolyte flow. It minimizes flow fluctuations in the direction of flow, thereby allowing more uniform dissolution over the mask surface. Back pressures between 0 and 15 psi (1 bf. per square inch) have been used to advantage.

A non-hydraulic technique for making the metal removal uniform is to adjust the size of the nickel cathode.

The mask area of the foil F (the area of the foil where etching will take place) and each metal cathode 320*a* and *b* are each rectangular or square in shape. For uniform dissolution of molybdenum on the foil F, the cathodes 320*a* and *b* are preferably made slightly smaller than the mask area by applying insulative coatings such as micro-stop. If the metal plates 320*a* and *b* are too small, the etching rate is higher in the middle of the mask area directly across from the nickel plate, so that the edges of the mask area are not etched fast enough; if the metal plates 320*a* and *b* are too large, the opposite problem occurs and metal is removed faster at the edges of the mask area, again causing non-uniformity.

In tests, it was found that 3-inch-square (9 square inches total area) metal plates 320*a* and *b* made of nickel worked very well as cathodes when the mask area of the foil was 4 inches square (16 square inches total area). Decreased etching at the edges of the mask area was noticed when the cathode was 2.5 inches square (6.25 square inches total area); when the cathode was larger than or equal in size to the masked area, the edges etched faster than the center of the moly mask.

In the apparatus of FIG. 3, the planar foil F anode and metal plates 320*a* and *b* are flat and held in parallel relation. It will be appreciated that in alternative embodiments of the present invention the foil F need not be held in a planar configuration. A flat foil may be held in a singly-curved configuration instead. ("Singly curved" refers to a surface curved in a single direction only, like a cylinder or cone.) An example would be foil wrapped partly about a cylindrical roller for immersion in electrolyte.

The present invention also contemplates that the foil be moved instead of being held stationary, and may be singly curved. For a curved foil surface the invention contemplates a cathode either located at a constant distance from the anode (as measured normal to the anode surface) or a cathode shaped to satisfy the main criterion, uniform flow of electrolyte over the surface. It is not necessary for the cathode to be flat.

If the foil were disposed over cylindrical rollers and the electrolyte flow were perpendicular to the roller axis, the main criterion for uniform flow over the foil would be uniform cross sections normal to the roller axes.

The invention may be used to fabricate both evaporation masks and screening masks but it is not limited to these. Etched or perforated metal foils for any use can be made by the invention.

While the invention has been described in terms of an exemplary embodiment, it is contemplated that it may be practiced as outlined above with modifications within the spirit and scope of the appended claims.

What is claimed:

1. A method of etching a molybdenum foil having a mask area, the method comprising the steps of:

placing a masking pattern onto the mask area of the molybdenum foil, the masking pattern including bare regions and coated regions;

disposing a cathode at a fixed inter-electrode distance from the mask area;

filling a space between the mask area and the cathode with a liquid electrolyte comprising a 2M–5M aqueous solution of sodium nitrate;

inducing the electrolyte to flow over the mask area;

providing a relatively positive voltage to the molybdenum foil and a relatively negative voltage to the cathode, such that the molybdenum foil is electroetched in the bare regions; and maintaining the relatively positive molybdenum foil voltage and the relatively negative cathode voltage until the molybdenum foil is etched through to provide openings.

2. The method according to claim 1, wherein the electrolyte is made pH basic.

3. The method according to claim 2, wherein the electrolyte includes 0.05–10M sodium hydroxide.

4. The method according to claim 1, wherein the electrolyte includes a surfactant.

5. The method according to claim 1, wherein the electrolyte includes a banking agent.

6. The method according to claim 5, wherein the banking agent is thiourea at a concentration of 10–30 mM.

7. The method according to claim 1, wherein the fixed inter- electrode distance is between 1 and 3 cm.

8. The method according to claim 7, wherein the fixed inter- electrode distance is between 1.5 and 2.5 cm.

9. The method according to claim 1, wherein the cathode has a surface area such that the surface area of the cathode is between about 40% and about 60% of the mask area.

10. The method according to claim 1, wherein the step of inducing flow includes providing a substantially uniform electrolyte flow velocity over the mask area.

11. An apparatus for electroetching molybdenum foil with a liquid electrolyte, the molybdenum foil having two surfaces, the apparatus comprising:

a container for holding an electrolyte comprising a 2M–5M aqueous solution of sodium nitrate;

a cathode disposed within the container and adapted to be immersed in the electrolyte;

holding means for holding the molybdenum foil such that the molybdenum foil is disposed within the container and adapted to be immersed in the electrolyte;

flow means for inducing electrolyte flow over the molybdenum foil;

anode means for applying a relatively positive electrical voltage to the molybdenum foil; and cathode means for applying a relatively negative electrical voltage to the cathode.

12. The apparatus according to claim 11, wherein the flow means includes uniform velocity means for providing a substantially uniform electrolyte flow velocity over a mask area of the foil.

13. The apparatus according to claim 12, wherein the uniform velocity means includes a hydraulic resistance element.

14. The apparatus according to claim 11, wherein:

the foil includes a sheet, the sheet having a central mask area and a perimeter; and, the holding means includes an open frame for removably holding the perimeter; such that the mask area of the sheet is immersed in the electrolyte.

15. The apparatus according to claim 14, wherein:

the sheet is held in a first planar configuration;

the laminar cathode is held in a second planar configuration; and the sheet and the cathode are parallel.

16. The apparatus according to claim 14, wherein the frame is removably insertable into the container through a top opening of the container, such that the mask area of the sheet is immersed in the electrolyte when the frame is inserted.

17. The apparatus according to claim 16, wherein both of the two surfaces of the foil are adapted to be immersed in the electrolyte.

18. A method of etching a metal foil, the foil having two sides together defining a mask area, the method comprising the steps of:

placing a stationary photoresist mask pattern onto both sides of the mask area of the foil, the photoresist mask pattern including bare regions and coated regions;

disposing a cathode on each side of said foil, each cathode at a fixed inter-electrode distance from the photoresist mask pattern;

filling a space between the mask area and the cathode with a liquid electrolyte;

inducing the electrolyte to flow over the mask area;

providing a relatively positive voltage to the foil and a relatively negative voltage to the cathode, such that the foil is electroetched in the bare regions; and maintaining the relatively positive foil voltage and the relatively negative cathode voltage until the foil is etched through to provide openings.

19. The method according to claim 18, wherein the fixed inter-electrode distance is between 1 and 3cm.

20. The method according to claim 19, wherein the fixed inter-electrode distance is between 1.5 and 2.5cm.

21. The method according to claim 18, wherein each cathode has a surface area and the surface area of each cathode is between about 40% and about 60% of the mask area of the foil.

22. An apparatus for electroetching a metal foil with a liquid electrolyte, the foil having two surfaces, each surface having a stationary photoresist mask, the apparatus comprising:

a container for holding the electrolyte;

two cathodes disposed within the container and adapted to be immersed in the electrolyte;

holding means for holding the foil such that the foil is disposed between the two cathodes and adapted to be immersed in the electrolyte;

flow means for inducing the electrolyte to flow over the foil;

anode means for applying a relatively positive electrical voltage to the foil; and cathode means for applying a relatively negative electrical voltage to the cathode.

23. A method of etching a metal foil, the foil having a mask area, the method comprising the steps of:

placing a masking pattern onto the mask area of the foil, the masking pattern including bare regions and coated regions;

disposing a cathode at a fixed inter-electrode distance from the mask area;

filling a space between the mask area and the cathode with a liquid electrolyte;

inducing the electrolyte to flow over the mask area;

assuring a substantially uniform electrolyte flow using an hydraulic resistance element;

providing a relatively positive voltage to the foil and a relatively negative voltage to the cathode, such that the foil is electroetched in the bare regions; and maintaining the relatively positive foil voltage and the relatively negative cathode voltage until the foil is etched through to provide openings.

24. An apparatus for electroetching metal foil with a liquid electrolyte, the foil having two surfaces, the apparatus comprising:

a container for holding an electrolyte;

a cathode disposed within the container and adapted to be immersed in the electrolyte;

holding means for holding the foil such that the foil is disposed within the container and adapted to be immersed in the electrolyte;

flow means which includes all hydraulic resistance element providing a substantially uniform electrolyte flow over the mask area of the foil;

anode means for applying a relatively positive electrical voltage to the foil; and cathode means for applying a relatively negative electrical voltage to the cathode.

* * * * *